US006948460B1

(12) United States Patent
Dow

(10) Patent No.: US 6,948,460 B1
(45) Date of Patent: Sep. 27, 2005

(54) CRANKSHAFT WITH VARIABLE STROKE

(76) Inventor: Glendal R. Dow, 1320 Hardisty, Bedford, TX (US) 76021

( * ) Notice: Subject to any disclaimer, the term of this patent is extended or adjusted under 35 U.S.C. 154(b) by 75 days.

(21) Appl. No.: 10/632,646

(22) Filed: Aug. 1, 2003

(51) Int. Cl.[7] ..... F02B 75/04
(52) U.S. Cl. ..... 123/48 B; 123/78 F
(58) Field of Search ..... 123/48 B, 78 F

(56) References Cited

U.S. PATENT DOCUMENTS 4,860,702 A 8/1989 Doundoulakis
5,908,014 A 6/1999 Leithinger
6,450,136 B1 * 9/2002 Klomp et al. ..... 123/78 E
6,564,762 B2 5/2003 Dow

* cited by examiner

*Primary Examiner*—Noah P. Kamen
(74) *Attorney, Agent, or Firm*—Bracewell & Patterson, L.L.P.

(57) ABSTRACT

A drive apparatus, particularly for an internal combustion engine, allows the compression ratio to be changed while operating. A piston is slidably carried in a cylinder. The piston rod engages a power gear via an eccentric link. The power gear rotates around a rim gear. The rim is biased to a maximum stroke position, however it is allowed to rotate toward an increased torque minimum stroke position.

20 Claims, 2 Drawing Sheets

CRANKSHAFT WITH VARIABLE STROKE

1. FIELD OF THE INVENTION

This invention relates in general to a device for translating linear reciprocating motion to rotary motion, and vice versa, and particularly to a crankshaft with a variable stroke for an engine or a pump.

2. BACKGROUND OF THE INVENTION

Internal combustion engines normally have at least one piston that is reciprocated within a cylinder. A rod connects the piston to a crankshaft that has offset portions. The offset portions of the crankshaft cause the end of the rod to orbit about an axis of the crankshaft. The rotation of the crankshaft drives a transmission or other load. Piston pumps operate in a similar manner, using a rotatably driven crankshaft to drive the piston.

One disadvantage of a conventional crankshaft is that the length of the stroke is fixed for a given crankshaft. Changing the length of the stroke will change the compression ratio, however this normally requires replacing the crankshaft. There are instances when a higher compression ratio is desired, such as at low load conditions, and instances when a lower compression ratio is desired, such as at high load conditions.

Proposals are shown in U.S. Pat. Nos. 5,908,014 and 4,860,702 for varying compression ratios of piston engines. Both of these patents utilize an eccentric at the rod end, the eccentric being connected to a gear train. The length of the stroke is selected by a gear arrangement that rotates the relative position of the eccentric to the gear train.

3. SUMMARY OF THE INVENTION

The crankshaft assembly of this invention converts linear reciprocating motion of a piston to rotary motion and vice versa. The piston has a piston rod with a first end connected to the piston and a second end that connects to a power gear through an eccentric. The eccentric is rigidly connected to the power gear at a point offset from the power gear shaft, so that as the second end of the rod strokes, the power gear will rotate.

The power gear engages a rim gear, causing the power gear to move about the axis of the rim gear while the rim gear is stationary. The rim gear has a pitch diameter that is a multiple of the pitch diameter of the power gear.

Rotating the rim gear less than one revolution will change the position of the eccentric relative to the rim gear. This change varies the length of the stroke of the piston. A bias member connected to the rim gear urges the rim gear to a position of maximum length stroke of the piston.

In the preferred embodiment, the rod end axis is located radially outward from a pitch diameter of the power gear. Also, preferably a pair of stops will stop rotation of the gear in both directions, the stops being located less than 90° apart from each other and preferably less than 55°.

4. BRIEF DESCRIPTION OF THE DRAWINGS

5. DESCRIPTION OF THE INVENTION

Figure 1:
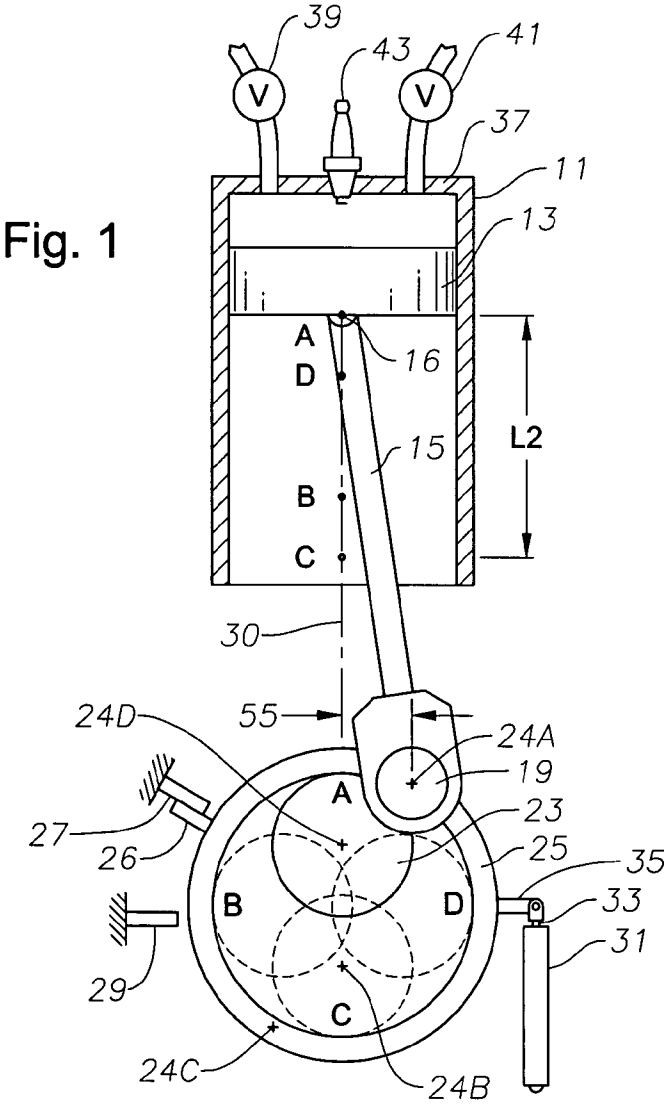
FIG. 1 is a schematic view, partially sectioned along the line 1—1 of FIG. 4, of a drive apparatus constructed in accordance with this invention and shown in a minimum feasible stroke position.

Referring to FIG. 1, cylinder 11 may be a cylinder of an internal combustion engine, a pump, or some other type of device. A linear moving member or piston 13 strokes reciprocally within cylinder 11. A piston rod 15 has a first end 16 that is pivotally connected to piston 13.

Figure 4:
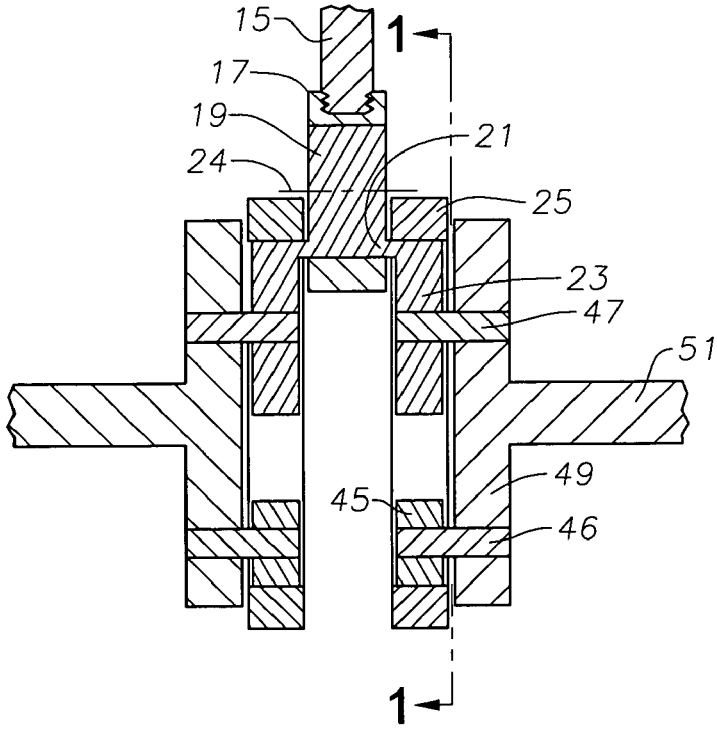
FIG. 4 is a sectional view of a portion of the drive apparatus of FIG. 1, taken along the line 4—4 of FIG. 2.

A link member or eccentric 19 has a cylindrical portion rotatably mounted in the second end 17 of rod 15. Eccentric 19 has a pair of crank pins 21 that are rigidly formed with or rigidly connected to it. As shown in FIG. 4, crank pins 21 extend from opposite sides of eccentric 19, offset from an axis 24 of rotation of rod end 17. Each crank pin is rigidly attached to a power gear 23. Crank pins 21 do not rotate relative to power gears 23, rather rotate with them. Crank pins 21 are offset from axis 24 of rod end 17, which coincides with the axis of eccentric 19. Axis 24 in this embodiment is spaced radially outward from power gears 23.

Figure 3:
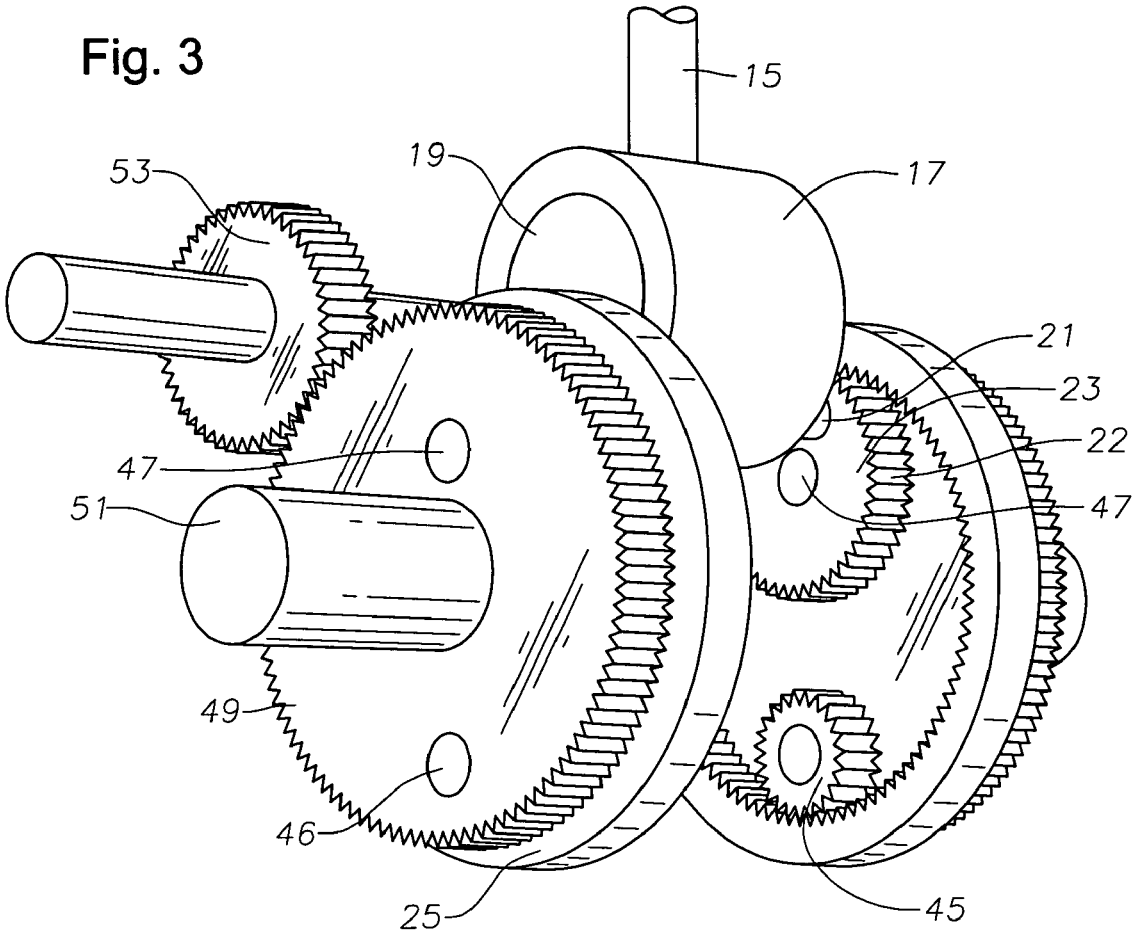
FIG. 3 is a perspective view illustrating a portion of the drive apparatus of FIG. 1.

Each power gear 23 has teeth 22 on its exterior, as shown in FIG. 3, defining a pitch diameter. The pitch diameter is measured between the outer diameter of power gear 23, measured at the tips of the teeth, and the root diameter of the teeth. Rod end axis 24 in the embodiment of FIG. 4 is located radially outward from the pitch diameter of teeth 22 of power gear 23. However, eccentric 19 could be reconfigured so that axis 24 coincides with the pitch diameter of teeth 22 or is located radially inward from the pitch diameter of teeth 22 of each power gear 23.

Teeth 22 of each power gear 23 engage teeth of a rim gear 25, which are located on the inner diameter of rim gear 25 in this embodiment. As each power gear 23 rotates, it will orbit about the axis of each rim gear 25. In the preferred embodiment, power gears 23 are able to rotate a full 360° around rim gear 25, however, in some cases, less than a full rotation would be desirable.

Figure 2:
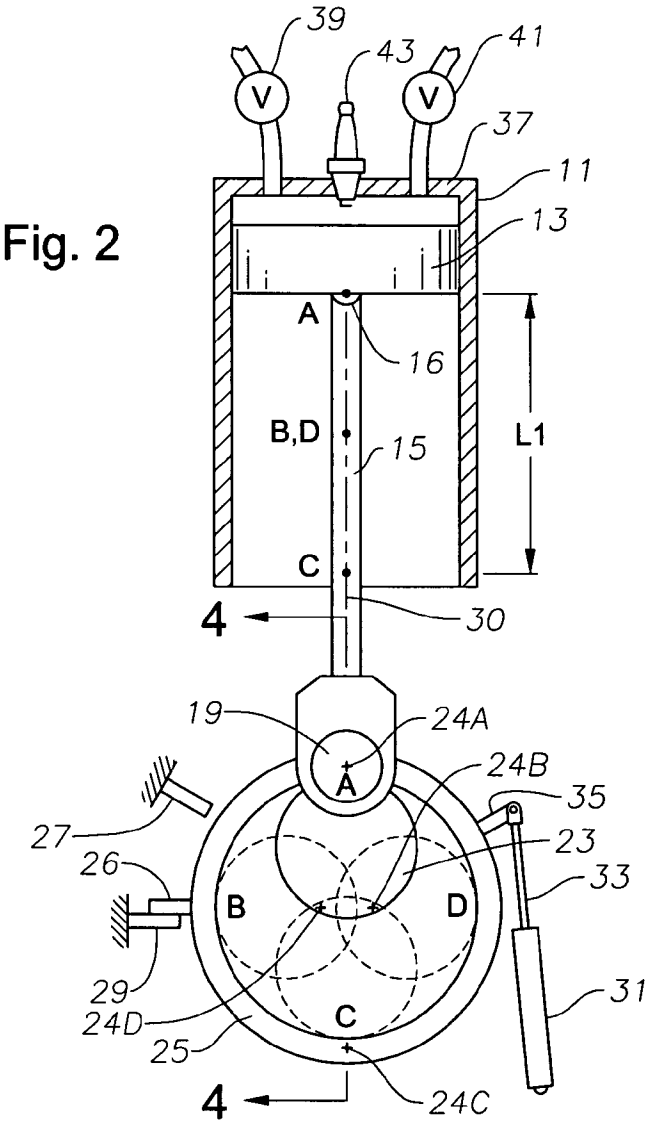
FIG. 2 is a sectional view of the drive apparatus of FIG. 1, and showing the drive apparatus in a maximum stroke position.

Rim gears 25 may be stationary while power gears 23 rotate. However, rim gears 25 are able to rotate a selected amount less than one revolution while power gears 23 are rotating. As shown in FIGS. 1 and 2, a stop contact 26 extends from each rim gear 25 and engages an advance stop 27, which stops rotation in a clockwise direction as shown in FIGS. 1 and 2. Counterclockwise rotation of each rim gear 25 is limited by a retract stop 29. Retract stop 29 is located so that it stops counterclockwise rotation of rim gear 25 at a point where the axis of power gear 23 intersects axis 30 of cylinder 11 while piston 13 is at the top dead center position, as shown in FIG. 2. The top dead center position is the uppermost position within cylinder 11.

Advance stop 27 is located a rotational amount from power gear 23 that is selected for the minimum feasible stroke position, which is illustrated in FIG. 1. The feasible amount of rotation of rim gear 25 is typically in the range from about 45° to 55° rotationally from first or retract stop 29. In the minimum feasible stroke position, when piston 13 is in the top dead center position, the axis of power gear 23 will intersect axis 30 of cylinder 11, but rod end axis 24 will be offset or rotationally spaced from axis 30 by 45° to 50°.

A bias member 31 is connected with the rim gears 25 to urge them to the maximum stroke position of FIG. 2. The bias member may be of various configurations, and in this embodiment, it is schematically illustrated to comprise a pneumatic cylinder 31 that has a rod 33 that exerts a force against a pivot point 35 on the edge of rim gear 25. The force applied by pneumatic cylinder 31 is continuous.

As mentioned previously, cylinder 11 could serve as a pump cylinder, however it is shown to be an internal combustion engine cylinder in this embodiment. In that context, cylinder 11 has a cylinder head 37 with an intake valve 39 and an exhaust valve 41 leading into the chamber between piston 13 and cylinder head 37. A spark plug 43 is shown for igniting a combustible mixture, however in the case of a diesel engine, spark plug 43 would not be required.

Referring again to FIGS. 3 and 4, an idler gear 45 preferably engages the teeth of each rim gear 25 and is located opposite power gear 23. Idler gear 45 rotates about a pin or shaft 46. Power gear 23 rotates concentrically about a pin 47 that is 180° from pin 46. Both pins 46 and 47 are secured to a crankshaft gear 49 offset from its axis. Crankshaft gear 49 has a crankshaft 51 on its axis that is secured to a transmission or other load. A driven gear 53 may optionally engage crankshaft gear 49 for rotating other equipment, such as a cam shaft or a stabilizing shaft.

In operation, FIGS. 1 and 2 illustrate piston 13 in a substantially top dead center position, which is indicated as position A. In FIG. 2, rim gear 25 is shown in a maximum stroke position. Rod end axis 24 is always located radially outward from power gears 23 relative to the axis of rim gear 25 because of the rigid connection between crank pin21 and power gear 23, and the rigid connection between crank pin 21 and eccentric 19. The numeral 24A indicates the position of rod end axis 24 while piston 13 is at the top dead center position. Rod end axis 24A intersects cylinder axis 30 while piston 13 is in the top dead center position and rim gear 25 in the maximum stroke position.

As piston 13 moves downward, it will cause power gear 23 to rotate about axis 47 and simultaneously rotate about the axis of rim gear 25. For illustration, power gear 23 is shown rotating counterclockwise about the axis of rim gear 25, but it could alternately rotate clockwise.

In Position B, as shown by dotted lines, power gear 23 has rotated 90° to a 270° position. Because of eccentric 19, rod end axis 24B has moved to a position to the right of the axis of rim gear 25. The linear distance piston 13 has traveled in this first 90° increment is illustrated alongside rod 15 within cylinder 11, this being the linear distance A to B.

For the next 90° increment, power gear 23 will rotate to the bottom dead center position indicated by the letter C. Rod end axis 24 has moved to the position indicated by the numeral 24C, which intersects cylinder axis 30. Piston 16 has now traveled the distance from A to C, this distance indicated by the numeral L1, which is the distance from top dead center to bottom dead center. The distance L1 is the maximum length of the stroke of piston 13 and provides the highest compression ratio.

For the next 90°, power gear 23 will travel from the 180° position to the 90° position indicated by the numeral D. Piston 13 has now traveled back to the distance D along the stroke. For the last 90°, power gear will 23 rotate back to the 0 or 360° position indicated by the numeral A. Note that the linear distance from A to B and from B to C is the same while in the maximum stroke position. The linear speed of piston 13 is the same throughout its stroke while in the maximum stroke position of FIG. 2.

Pneumatic cylinder 31 exerts a continual bias force tending to cause rim gear 25 to rotate counterclockwise to the maximum stroke position of FIG. 2. A reactive force that is a result of the load opposes this bias force. If the load increases sufficiently, the reactive force overcomes the bias force and causes rim gear 25 to rotate clockwise toward the minimum feasible stroke position of FIG. 1. Although the rotation toward the minimum feasible stroke position occurs while piston 13 is reciprocating, for illustration purposes, assume that this rotation occurs while piston 13 remains at the top dead center position. If so, the axis of power gear 23 would remain stationary on the axis of cylinder 30. Power gear 23 would rotate clockwise from the position of FIG. 2 to the position of FIG. 1 while its axis remains on cylinder axis 30. Piston 13 would move downward a short distance, rod 15 will incline relative to cylinder axis 30, and rod end axis 24A will be approximately 45° to 55° from the position of FIG. 1 relative to the axis rim gear 25. Stop 26 will be in contact with advance stop 27. The rotation of rim gear 25 toward the minimum feasible stroke position causes pneumatic cylinder rod 33 to retract.

While in the minimum feasible stroke position, an offset 55 will exist between the longitudinal axis 30 of cylinder 11 and rod end axis 24A. Offset is a lateral distance between axis 30 and rod end axis 24A, and is similar to a moment arm. At top dead center, an increased offset 55 results in more torque being available than when an offset 55 does not exist, as in FIG. 2.

While in the position of FIG. 1, as piston 13 moves downward while rim gear 25 is stationary, power gear 23 will rotate counterclockwise as indicated by the dotted lines. At the 270° or B position, rod end axis 24B will have moved to a position near the longitudinal axis 30 and substantially lower than where it was in FIG. 1 in the B position. The linear distance that rod end 16 travels from A to B is considerably more than the linear distance that rod end 16 travels from A to B in FIG. 2 even though in both cases, the rotation of power gear 23 was the same amount, 90°. This means that piston 13 traveled at a much faster velocity during the minimum feasible stroke position from its top dead center to the 90° position than in the maximum stroke position.

While moving from position B to position C, rod end axis 24C will be located farther rotationally than 24B and somewhat lower. The linear distance that rod end 16 travels from B to C in the minimum feasible stroke position is less than from A to B and also less than from B to C in the maximum stroke position of FIG. 2. The velocity of piston 13 thus is slower when moving from B to C in the minimum feasible stroke position than in the maximum stroke position.

As power gear 23 moves from position C to position D, rod end axis 24D will locate near the longitudinal axis 30 and closer to position A than position B. The linear distance along axis 30 from position C to position D is the same as the distance from position A to position B. The velocity thus is much faster than the velocity from position B to position C. The velocity from position C to position D is also faster than the velocity from position C to position D in the maximum stroke position of FIG. 2. The final 90° from position D back to position A results in much slower movement as the linear distance along axis 30 from position D to position A is much shorter than the distance from position A to position B.

As mentioned above, the bias of pneumatic cylinder 31 can overcome the reactive force on rim gear 25 due to the load on the engine if the load lessens. While the load is dropping, rim gear 25 may move back all the way to the position of maximum stroke in FIG. 2 or some degree between. Rim gear 25 is thus free to rotate to a position that matches the load.

The path traced by rod end axis 24 from position A through D has the same elliptical configuration regardless of whether rim gear 25 is in a maximum stroke position, a minimum feasible stroke position, or somewhere between. However, the angle of the major axis of the ellipse varies. In FIG. 2, the major axis of the ellipse is centered along and parallel to cylinder axis 30. In FIG. 1, the major axis of the ellipse is tilted to an angle of approximately 45° to 55° relative to cylinder axis 30.

The minimum feasible stroke position is selected so as to optimize the torque without unduly reducing the overall stroke of piston 13. As indicated by the distances L1 and L2, the total stroke shortens when going from the maximum stroke position L1 to the increased torque position of L2. If, for example, rim gear 25 were allowed to rotate past the minimum feasible stroke position of FIG. 2 to 90°, then offset 55 would be much greater. However, the stroke would be very short, being only the width of the ellipse because the major axis of the ellipse would be perpendicular to longitudinal axis 30. The actual minimum stroke position is 90°, but the minimum feasible stroke position is preferably between 45° and 55°, although it possibly could be greater.

The invention has significant advantages. The drive train allows the compression ratio of an engine or a pump to change while the engine is operating. The bias imposed on the rim gear allows the rim gear to reach a point of balance depending upon the particular load. Increased load automatically causes the rim gear to rotate in one direction, while decreased load causes the rim gear to rotate in the other direction. The large eccentric that places the rod end axis outside the pitch diameter of the power gear provides additional torque when needed. When the stroke is decreased, the velocity of the piston becomes nonlinear, with the velocity being much faster during the beginning of the stroke and the return of the stroke. This has an advantage of more rapidly moving the piston away during a combustion stroke to enhance cooling of the piston. The more rapid velocity provides increased power during the initial part of the combustion stroke.

While the invention has been shown in only one of its forms, it should be apparent to those skilled in the art that it is not so limited but is susceptible to various changes without departing from the scope of the invention.

I claim:

1. A drive apparatus, comprising:

a piston slidably carried in a cylinder for stroking reciprocally along an axis of the cylinder;

a piston rod having a first end connected to the piston and a second end;

a power gear concentrically mounted to a power gear shaft;

an eccentric connected between the second end of the piston rod and the power gear, the second end of the piston rod having a rod end axis offset from the power gear shaft, so that as the second end of the rod strokes, the power gear rotates;

a rim gear having teeth on that mesh with teeth on the power gear, causing the power gear to orbit around an axis of the rim gear while the rim gear is stationary, the axis of the rim gear being on the axis of the cylinder, the rim gear having a pitch diameter that is a multiple of a pitch diameter of the power gear;

the rim gear being rotatable an increment less than one revolution about its axis, causing the position of the eccentric relative to the rim gear to change, thereby varying the length of the stroke of the piston; and a bias member connected to the rim gear to urge the rim gear to rotate toward a position of maximum stroke of the piston.

2. The drive apparatus according to claim 1, wherein the rod end axis is located radially outward from the power gear, relative to the power gear shaft.

3. The drive apparatus according to claim 1, wherein the rod end axis is spaced radially from a pitch diameter of the power gear.

4. The drive apparatus according to claim 1, wherein in the maximum stroke position, with the piston at top dead center, the rod end axis intersects the axis of the cylinder.

5. The drive apparatus according to claim 1, further comprising a stop that limits the extent of rotation of the rim gear toward the maximum stroke position.

6. The drive apparatus according to claim 1, further comprising:

a first stop that stops rotation of the rim gear in one direction; and a second stop that stops rotation of the rim gear in the opposite direction.

7. The drive apparatus according to claim 1, wherein an increase in load requirements of the drive apparatus overcomes the bias member and causes the rim gear to rotate toward a minimum stroke position.

8. The drive apparatus according to claim 1 further comprising:

a crankshaft gear concentrically mounted to a primary shaft for rotation therewith, the power gear shaft engaging the crankshaft gear at a point offset from the primary shaft, wherein as the power gear orbits about the axis of the rim gear, the crankshaft gear and primary shaft rotate.

9. The drive apparatus according to claim 1, further comprising at least one valve for admitting atomized fuel to the cylinder.

10. The drive apparatus according to claim 1, further comprising an advance stop that limits rotation of the rim gear away from the maximum stroke position, and wherein while the rim gear is at the advance stop and the piston at top dead center, the rod end axis is offset from the axis of the cylinder.

11. A drive apparatus, comprising:

a piston slidably carried in a cylinder for stroking reciprocally along an axis of the cylinder;

a piston rod having a first end connected to the piston and a second end;

a power gear concentrically mounted to a power gear shaft;

an eccentric rigidly connected to the power gear, the second end of the piston rod being rotatably mounted to the eccentric for rotation about a rod end axis that is radially outside of a pitch diameter of the power gear while the piston is in a top dead center position; and a rim gear having teeth that mesh with teeth on the power gear, causing the power gear to orbit about an axis of the rim gear as the power gear rotates.

12. The drive apparatus according to claim 11, wherein the rim gear is rotatable about its axis for an increment less than one revolution to vary the rotational position of the rod end axis relative to the rim gear.

13. The drive apparatus according to claim 11, wherein the rim gear is rotatable about its axis for an increment less than one revolution; and wherein the apparatus further comprises:

a bias member that urges the rim gear to rotate toward a position that places the rod end axis on the axis of the cylinder when the piston is at top dead center.

14. The drive apparatus according to claim 11, wherein the rim gear is rotatable about its axis in first and second directions; and wherein the apparatus further comprises:

a first stop that stops rotation of the rim gear in the first direction at a point where the rod axis intersects the cylinder axis while the piston is at top dead center; and a second stop that stops rotation of the rim gear in the second direction no more than 90 degrees from the first stop.

15. The drive apparatus according to claim 14, wherein the second stop is no farther than 55 degrees from the first stop.

16. The drive apparatus according to claim 11, wherein the rim gear is rotatable about its axis for an increment less than one revolution; and wherein the apparatus further comprises:

a bias member that urges the rim gear to rotate toward a maximum stroke position that places the rod end axis on the axis of the cylinder when the piston is at top dead center; and wherein a load of sufficient magnitude applied to the drive apparatus overcomes the bias member to rotate the rim gear away from the maximum stroke position.

17. A method of translating rotary motion and reciprocating motion of a piston stroking within a cylinder and connected to a first end of a piston rod, comprising:

(a) connecting a power gear concentrically to a power gear shaft;

(b) rigidly connecting an eccentric to the power gear, and rotatably connecting a second end of the rod to the eccentric for rotation about a rod end axis that is offset from the power gear shaft;

(c) mounting the power gear into meshing engagement with a rim gear;

(d) connecting the power gear shaft eccentrically to a crankshaft gear, which is connected concentrically to a crankshaft;

(e) biasing the rim gear to rotate in a first direction toward a position where the rod end axis and an axis of the power gear shaft simultaneously pass through an axis of the cylinder; and (f) reciprocating the piston, rotating the power gear in orbital motion about an axis of the rim gear, and rotating the crankshaft gear; and (g) as load increases, rotating the rim gear in a second direction toward a position wherein the rod end axis of the piston rod is laterally offset from the axis of the cylinder while the axis of the power gear shaft passes through the axis of the cylinder.

18. The method according to claim 17, wherein step (g) comprises overriding the bias of the rim gear in response to the torque required to rotate the crankshaft.

19. The method according to claim 17, wherein step (g) comprises stopping rotation of the rim gear in the second direction no more than 90 degrees from the position of step (e).

20. The method according to claim 17, wherein step (g) comprises stopping rotation of the rim gear in the second direction no more than 55 degrees from the position of step (e).

* * * * *